US007638462B2

(12) United States Patent
Kawamura et al.

(10) Patent No.: US 7,638,462 B2
(45) **Date of Patent: *Dec. 29, 2009**

(54) THERMAL TRANSFER RECEIVING SHEET

(75) Inventors: Masato Kawamura, Tokyo (JP); Yoshimasa Tanaka, Tokyo (JP); Toshikazu Onishi, Tokyo (JP); Kyoko Uchida, Tokyo (JP); Chikara Tsukada, Tokyo (JP); Toru Nakai, Tokyo (JP); Kazuyuki Tachibana, Tokyo (JP); Yoshihiro Shimizu, Tokyo (JP); Yoshio Mizuhara, Tokyo (JP); Hideaki Shinohara, Tokyo (JP); Hisayoshi Mito, Tokyo (JP)

(73) Assignee: OJI Paper Co., Ltd., Tokyo (JP)

( * ) Notice: Subject to any disclaimer, the term of this patent is extended or adjusted under 35 U.S.C. 154(b) by 289 days.

This patent is subject to a terminal disclaimer.

(21) Appl. No.: 11/596,817

(22) PCT Filed: May 17, 2005

(86) PCT No.: PCT/JP2005/009303

§ 371 (c)(1),
(2), (4) Date: Nov. 17, 2006

(87) PCT Pub. No.: WO2005/110770

PCT Pub. Date: Nov. 24, 2005

(65) Prior Publication Data

US 2008/0085831 A1 Apr. 10, 2008

(30) Foreign Application Priority Data

May 17, 2004 (JP) ..... 2004-146736
Nov. 2, 2004 (JP) ..... 2004-319331

(51) Int. Cl.
*B41M 5/50* (2006.01)

(52) U.S. Cl. ..... 503/227; 428/32.39

(58) Field of Classification Search ..... None
See application file for complete search history.

(56) References Cited

U.S. PATENT DOCUMENTS 6,372,689 B1 4/2002 Kuga et al. ..... 503/227

FOREIGN PATENT DOCUMENTS

| | | |
|---|---|---|
| EP | 0234563 | 9/1987 |
| EP | 0540991 | 5/1993 |
| EP | 0893273 | 1/1999 |
| EP | 0921015 | 6/1999 |
| JP | 7-89244 | 4/1995 |
| JP | 7-117364 | 5/1995 |
| JP | 9-99651 | 4/1997 |
| JP | 11-34515 | 2/1999 |
| JP | 2001-39043 | 2/2001 |
| JP | 2002-192842 | 7/2002 |
| JP | 2002-212890 | 7/2002 |
| WO | WO2004/078480 | 9/2004 |
| WO | WO2005/011995 | 2/2005 |

OTHER PUBLICATIONS

Search report dated Nov. 12, 2007.

*Primary Examiner*—Bruce H Hess
(74) *Attorney, Agent, or Firm*—Kratz, Quintos & Hanson, LLP

(57) ABSTRACT

A thermal transfer receiving sheet having laminated, on one side of its support, an intermediate layer, a barrier layer and an image receiving layer in this order, wherein said intermediate layer comprises hollow particles, and said barrier layer comprises a polyvinyl alcohol derivative, and comprises, as further main components, a resin or a mixture of two or more resins selected from the group consisting of a styrene-maleic acid copolymer, a styrene-acrylic copolymer, an acrylic acid ester polymer and polyester, or wherein said barrier layer comprises, as main components, an ethylene vinyl alcohol copolymer and polyurethane.

20 Claims, No Drawings

THERMAL TRANSFER RECEIVING SHEET

FIELD OF THE INVENTION

The present invention relates to a thermal transfer receiving sheet. More particularly, it relates to a thermal transfer receiving sheet (hereinafter referred to simply as "receiving sheet") that has a high image quality, a high image quality-retaining property, an excellent curling property at the time of image printing, and is inexpensive.

BACKGROUND ART

In recent years, attention has been focused on thermal transfer printers, particularly dye thermal transfer printers capable of printing clear full-color images. Dye thermal transfer printers form images by superimposing a dye layer containing dyes of an ink ribbon onto an image receiving layer (hereinafter referred to simply as a "receiving layer") containing a dye-dyeable resin on a receiving sheet, and then by transferring the desired density of the dye on the desired spots of the ink ribbon dye layer to the receiving layer with the heat supplied from a thermal head etc. The ink ribbon comprises a three-color dye layer consisting of yellow, magenta and cyan or a four-color dye layer comprising black in addition to the above. Full-color images can be obtained by transferring repeatedly and sequentially the dye for each color of the ink ribbon onto the receiving sheet. The dye thermal transfer method is replacing the silver salt photograph as a method that enables the recording of high quality images, and also as a method that enables digital printing with the recent prevalence of digital cameras.

As a method for improving the density, image quality etc. of recorded images, there has been proposed a method of using an intermediate layer that employs foaming particles on the substrate (see, for example, Japanese Unexamined Patent Publication (Kokai) No. 1-27996 (page 1) and Japanese Unexamined Patent Publication (Kokai) No. 63-87286 (page 1)). Insulating, smoothing and cushioning properties are essential characteristics in order to use heat from the thermal head for image printing, and significantly affect the quality of the images printed and the density of the images. Specifically, when printing images, a receiving sheet is brought into contact with the thermal head via the ink ribbon, and is pressed by a rubber roll called the platen roll from the other side. A receiving sheet having a good cushioning property comes into complete contact with the ink ribbon due to the pressure applied by the rubber roll, and thereby attains the even transfer of the ink leading to a good image quality, whereas voids are formed in a receiving sheet having a poor cushioning property and ink transfer becomes disturbed in the voids, producing unevenness in the images. Thus, the cushioning property is one of the most important qualities for the receiving sheet.

Furthermore, in order to enhance image quality, an intermediate layer that utilizes hollow particles of a specific size has been proposed (see, for example, Japanese Unexamined Patent Publication (Kokai) No. 9-99651 (pages 2-4)). However, in the receiving sheets formed by these methods, the dye that was transferred to the receiving layer penetrates into the lower layer and then diffuses up to the intermediate layer (hereinafter referred to as "blurring"), producing blurred images, and thus the image retaining property is unsatisfactory. Thus, in order to prevent the blurring of receiving sheets having an intermediate layer containing foaming particles, a protective layer (also called a barrier layer) having a high barrier property is essential.

In order to prevent the penetration of coating components of the receiving layer or solvents in the coating of the receiving layer, there has been proposed a method of introducing a layer containing a plate-form inorganic dye having an aspect ratio of 5-90 on an primer coating layer (intermediate layer) containing hollow particles (see, for example, Japanese Unexamined Patent Publication (Kokai) No. 6-227159 (page 2)). However, it is not sufficient to prevent the penetration of image-forming dyes into the intermediate layer and, in the case of dyes for sublimation thermal transfer, there is practically no effect of preventing blurring since it is penetration on a single molecule level. Thus, in order to prevent blurring, the coated amount of the barrier layer should be increased, but excessive increases in the coating amount of the barrier layer may reduce the flexibility of the barrier layer and may cause cracking when the receiving sheet is bent to thereby reduce the commercial value. Also, the insulating effect of the intermediate layer may decrease, and the printing density may decrease leading to blurred images. In the on-going replacement of the silver salt photograph in recent years, receiving sheets having a high image quality and a high image retaining property are being sought, and there is a demand for a better technology.

Similarly, as a method of preventing the penetration of coating components of the receiving layer and solvents in the coating of the receiving layer, a barrier layer that combines polyvinyl alcohol with a polyurethane resin has been proposed (see, for example, Japanese Unexamined Patent Publication (Kokai) No. 11-34515 (pages 2-4)). However, the above diffusion of the dye into the intermediate layer has not been taken into consideration, and the image retaining property is not sufficient. Besides, with the above combination of polyvinyl alcohol and a polyurethane resin, there is no flexibility of the barrier layer and cracking may easily occur thereby reducing the commercial value.

It is preferable that the intermediate layer (corresponding to the barrier layer) is formed from a coating solution comprising an aqueous solution of a water-soluble resin, and a dispersion of a resin or an emulsion of a resin, wherein the resin has a glass transition temperature of −30° C. to 20° C. (see, for example, Japanese Unexamined Patent Publication (Kokai) No. 8-25813 (page 2)). Though such a barrier layer has an excellent plasticity, however, diffusion of the dye into the intermediate layer has not been taken into consideration, and the image retaining property was not sufficient and the barrier property against solvents was not perfect.

Furthermore, a barrier layer that uses an ethylene vinyl alcohol copolymer alone has been proposed (see, for example, Japanese Unexamined Patent Publication (Kokai) No. 7-89244 (page 2)). With the use of an ethylene vinyl alcohol copolymer alone, the barrier property at a high temperature is not sufficient, and cannot fully prevent the diffusion of the dye from the receiving layer to the substrate.

Also, as described above, an improvement in transfer density resulting from the insulating effect has been proposed. It introduces an intermediate layer containing hollow particles in between the support and the receiving layer using papers as the support substrate of the receiving sheet (see the above Japanese Unexamined Patent Publication (Kokai) No. 1-27996 and Japanese Unexamined Patent Publication (Kokai) No. 63-87286). However, papers vary in stiffness with humidity and, under the condition of low humidity, stiffness may be increased with a result that the uneven thickness of papers can cause uneven density during image printing, and thereby the mere introduction of the intermediate layer cannot fully improve transfer density.

Also, there has been proposed a thermal transfer receiving sheet that has been imparted with a cushioning property and insulating property and that has no white spots or uneven density during printing by using a sulfite pulp as the above substrate for the support (see, for example, Japanese Unexamined Patent Publication (Kokai) No. 8-2123 (page 2)). However, the sulfite pulp has a disadvantage that it has a low strength, its effect of improving unevenness in paper thickness is insufficient and, specifically, it cannot overcome the unevenness in image printing resulting from uneven thickness under the condition of a low humidity.

DISCLOSURE OF THE INVENTION

The present invention was accomplished considering the above circumstances, and its purpose is to provide a thermal transfer receiving sheet which is of a high image quality, is free of blurring in printed images over time, has a good image-retaining property, is inexpensive, and in which cracking on the image-printed surface by bending will not easily occur.

The present invention encompasses each of the following embodiments:

(1) A thermal transfer receiving sheet having laminated, on one side of its support, an intermediate layer, a barrier layer and an image receiving layer in this order, wherein said intermediate layer comprises hollow particles, and said barrier layer comprises a polyvinyl alcohol derivative, and comprises, as further main components, a resin or a mixture of two or more resins selected from the group consisting of a styrene-maleic acid copolymer, a styrene-acrylic copolymer, an acrylic acid ester and polyester;

(2) The thermal transfer receiving sheet according to (1) wherein the glass transition temperature (Tg) of the above resin or a mixture of two or more resins selected from the group consisting of a styrene-maleic acid copolymer, a styrene-acrylic copolymer, an acrylic acid ester polymer and polyester is 45° C. or higher and 120° C. or lower;

(3) The thermal transfer receiving sheet according to (1) or (2) wherein the ratio contained of the above resin or a mixture of two or more resins selected from the group consisting of a styrene-maleic acid copolymer, a styrene-acrylic copolymer, an acrylic acid ester polymer and polyester is 30-300 parts by weight relative to 100 parts by weight of the polyvinyl alcohol derivative in said barrier layer;

(4) The thermal transfer receiving sheet according to any of (1) to (3) wherein the above polyvinyl alcohol derivative is a resin or a mixture of two or more resins selected from the group consisting of a fully saponified polyvinyl alcohol, a partially saponified polyvinyl alcohol, a silanol-modified polyvinyl alcohol and an ethylene vinyl alcohol copolymer;

(5) A thermal transfer receiving sheet having laminated, on one side of its support, an intermediate layer, a barrier layer and an image receiving layer in this order, wherein said intermediate layer comprises hollow particles, and said barrier layer comprises, as main components, an ethylene vinyl alcohol copolymer and polyurethane;

(6) The thermal transfer receiving sheet according to any of (1) to (5) wherein the mean particle size of the above hollow particles is 0.1 μm or greater and 20 μm or smaller;

(7) The thermal transfer receiving sheet according to any of (1) to (6) wherein said support has an adhesive layer on the other side of the image receiving layer and wherein said adhesive layer side and the release layer side of the release sheet having a release layer containing a release agent have been laminated to face each other; and (8) The thermal transfer receiving sheet according to any of (1) to (7) wherein the integral (PY value) of the power spectrum at wavelengths of 1-12.5 mm of said support surface is 150 mV or less.

The receiving sheet of the present invention is of a high image quality, is free of blurring in printed images over time, has a high image retaining property, cracking on the image-printed surface by bending will not easily occur, and it is inexpensive. The receiving sheet practically highly valuable.

BEST MODE FOR CARRYING OUT THE INVENTION

The present invention will now be explained in detail below.

The present inventors have investigated various materials for the barrier layer in order to solve the above problem of blurring in thermal transfer dye images. For example, normal resins of polyvinyl alcohol, acrylic copolymers etc. can be formed into films on the intermediate layer, but when image-printed sheets are left in a pocket of clothing for a long time or when they became wet in the rain outdoors, marked blurring can occur. Thus, normal resins of polyvinyl alcohol, acrylic copolymers etc. cannot provide a sufficient barrier property or a moisture resistance under the condition of high humidity or when directly contacted with water. Also, though highly crosslinked polyurethanes are generally known to have a high barrier property, they cannot easily be formed into films on the intermediate layer and the barrier property may decrease when they are attempted to be applied alone into the barrier layer of the present invention.

After investigation on various materials for the barrier layer in order to solve the above problem of blurring in thermal transfer dyed images, the present inventors have found that, as the resin for the barrier layer, use of a polyvinyl alcohol derivative as a principal component of the barrier layer and the combined use of a resin or a mixture of two or more resins selected from the group consisting of a styrene-maleic acid copolymer, a styrene-acrylic copolymer, an acrylic acid ester polymer and polyester as a further principal component in order to impart heat resistance can provide an effect of preventing blurring and simultaneously of avoiding the cracking of the barrier layer during bending of the receiving sheet. Among them, a styrene-acrylic copolymer is preferably used and provides a more excellent effect.

Also, it was found that by using polyurethane in combination with an ethylene vinyl alcohol copolymer, which is one of the polyvinyl alcohol derivatives, a similarly excellent effect can be obtained.

Furthermore, it is preferred that the glass transition temperature (Tg) of a resin or a mixture of two or more resins selected from the group consisting of a styrene-maleic acid copolymer, a styrene-acrylic copolymer, an acrylic acid ester polymer and polyester, or the Tg of polyurethane is 45° C. to 120° C.

As polyvinyl alcohol derivatives for use as the principal component of the barrier layer of the present invention, there can be mentioned ethylene vinyl alcohol copolymers and polyvinyl alcohols. As the degree of polymerization of the ethylene vinyl alcohol copolymers, about 100-300 is preferable.

Ethylene vinyl alcohol copolymers even at a low degree of polymerization can exhibit an excellent water resistance, and their aqueous solutions have extremely low viscosity and thus are suitable for use in film-forming coatings. The degree of polymerization of ethylene vinyl alcohol copolymers for use in the present invention is preferably about 100-2000, more preferably about 200-1000. Tg is usually 0° C. or lower. As specific examples, there can be mentioned trade names "RS4103", "RS4105", "RS2117" and "HR3010" manufactured by Kuraray, and the like.

As polyvinyl alcohols, there can be mentioned fully saponified polyvinyl alcohols (the degree of saponification: 97-100%), partially saponified polyvinyl alcohols (the degree of saponification: 76-97%), and the like. Polyvinyl alcohols with the degree of polymerization of 200-2000 are preferably used. As such polyvinyl alcohols, commercially available products can be preferably used, and include, for example, PVA102, 103, 105, 117 and 120 (these are fully saponified polyvinyl alcohols manufactured by Kuraray), PVA617, 203, 205, 210, 217, 220, 403, 405 and 420 (these are partially saponified polyvinyl alcohols manufactured by Kuraray) etc. each with different degree of polymerization and different degree of saponification.

Furthermore, there can be mentioned modified polyvinyl alcohols such as silanol-modified polyvinyl alcohols, carboxy-denatured polyvinyl alcohols, acetoacetyl-modified polyvinyl alcohols, cation-modified polyvinyl alcohols, and mercapto group-containing polyvinyl alcohols. Polyvinyl alcohols with the degree of polymerization of 200-2000 are preferably used. As various modified polyvinyl alcohols, R-1130, R-2105 and R-2130 (silanol-modified polyvinyl alcohols manufactured by Kuraray), KL-506 and KL-318 (carboxy-modified polyvinyl alcohols manufactured by Kuraray), Z-200, 210 and 320 (acetoacetyl-modified polyvinyl alcohols manufactured by Nippon Gohsei), C-506 and CM-318 (cation-modified polyvinyl alcohols manufactured by Kuraray), M-115 and M-205 (mercapto-containing polyvinyl alcohols manufactured by Kuraray) etc. are commercially available.

Silanol-modified polyvinyl alcohols may be produced by conventionally known synthetic methods, in which, for example, vinyl trimethoxysilane and vinyl acetate are copolymerized in methanol etc. and then vinyl acetate is saponified by methanolysis with sodium hydroxide as a catalyst to obtain the desired polymerized product. The silanol-modified polyvinyl alcohols preferably have a degree of saponification of 85% or more and the content of the silanol group in the molecule is preferably 0.05-3 mole % as monomer units.

Among the above polyvinyl alcohol derivatives, fully saponified polyvinyl alcohols, partially saponified polyvinyl alcohols, silanol-modified polyvinyl alcohols and ethylene vinyl alcohol copolymers and the like are preferably used, and they have an excellent barrier effect against solvents, effects of preventing dye travel, flexibility, suitability for coating and the like.

In accordance with the present invention, the ratio of a component material of the barrier layer which is a resin or a mixture of two or more resins selected from the group consisting of a styrene-maleic acid copolymer, a styrene-acrylic copolymer, an acrylic acid ester polymer and polyester or polyurethane and the Tg of which is 45° C. or higher and 120° C. or lower is preferably 30-300 parts by weight, more preferably 50-50 parts by weight relative to 100 parts by weight of the polyvinyl alcohol derivative in said barrier layer. If the ratio contained of the above resin or resin mixture is less than 30 parts by weight relative to 100 parts by weight of the polyvinyl alcohol derivative in the barrier layer, a sufficient barrier effect cannot be obtained and the effect of improving blurring may not be sufficient. On the other hand, if it exceeds 300 parts by weight, breaking may occur when the receiving sheet is bent.

Also, in accordance with the present invention, the Tg of a resin or a mixture of two or more resins selected from the group consisting of a styrene-maleic acid copolymer, a styrene-acrylic copolymer, an acrylic acid ester polymer and polyester or polyurethane for use as the component material of the barrier layer is preferably 45° C. or higher and 120° C. or lower. If the Tg is less than 45° C., the effect of preventing blurring at high temperature may be low. On the other hand, if it exceeds 120° C., breaking may occur when the receiving sheet is bent.

With respect to the regulation of Tg of copolymers, copolymers having the desired Tg can be designed as appropriate by selecting the Tg of various polymers described in any appropriate reference such as "Kobunshino Bussei II, Kobunshi Jikkengaku Koza 4 (Physical Properties of Polymers II, Polymer Experiment Series 4)", KYORITSU SHUPPAN, page 51 (1959), in accordance with $$\text{Fox equation } (1/Tg=\Sigma wi/Tgi)$$

wherein "wi" represents the partial mass ratio of each component and "Tgi" represents the Tg of each component. As used herein, the glass transition temperature (Tg) of the barrier layer resin of the present invention is a value determined using a differential scanning calorimeter (trade name: DS/5200, manufactured by Seiko Instruments, Inc.) in accordance with a method provided in JIS K 7121.

As a material constituting the barrier layer, various inorganic and organic pigments, waxes, metal soap etc. can be used, and, as needed, various additives such as UV absorbing agents, fluorescent dyes, oil repellant agents, anti-foaming agents, viscosity controlling agents, crosslinking agents and curing agents can be used as long as they do not impair the desired effect. The coating amount in terms of solid content of the barrier layer is preferably 0.1-10 g/m$^2$, and more preferably 0.5-5 g/m$^2$. If the coating amount in terms of solid content of the barrier layer is less than 0.1 g/m$^2$, the barrier layer will not be fully formed into a film, and may not exhibit the desired effect of preventing image blurring. Also, if the coating amount in terms of solid content exceeds 10 g/m$^2$, the effect of preventing image blurring will be saturated and thus is not economically desirable.

As the support for the receiving sheet of the present invention, there can be used papers comprising cellulose pulp as the principal component, synthetic resin films and the like. As papers, there can be mentioned wood-free paper (acid paper, neutral paper), non-coated paper such as medium quality paper, coated paper, art paper, glassine paper, resin laminated paper or converted paper. As synthetic resin films, there can be mentioned stretched films comprising, as the principal components, polyolefins such as polyethylene and polypropylene, polyester such as polyethylene terephthalate, polyamide, polyvinyl chloride, polystyrene etc., and monolayer stretched films or multilayer stretched films (synthetic paper) comprising inorganic pigments and/or organic fillers and as the principal components, thermoplastic resins such as polyolefin. Laminates of these films or composite laminates in which these films and other films or paper etc. are laminated and stuck together are used as appropriate. When papers comprising cellulose pulp as the principal component are used as the support, it is cost-effective and the texture of the resultant receiving sheet is close to that of the silver salt photograph, and thus further excellent effect of the present invention can be obtained. However, the present invention is not limited to use of such papers. The support in the sheet form of the present invention preferably has a thickness of 20-30 μm.

In accordance with the present invention, with regard to the surface of the support, the integral (PY value) of the power spectrum at wavelengths of 1-12.5 mm is preferably 150 mV or less and more preferably in the range of 0-100 mV. The PY value in such a range is preferred when papers are used as the support. If the PY value exceeds 150 mV, white spots or unevenness in printed images may occur due to unevenness in the thickness of the support.

The PY value according to the present invention can be obtained using a film caliper by continuously measuring unevenness in thickness of the sheet-form support and by analyzing the obtained signal values using a frequency analyzer. In this case, the PY values are expressed as an electric voltage (Vrms) value, and smaller values mean that the thermal transfer receiving sheet has smaller unevenness (bulges) in thickness and has a even and preferred surface smoothness.

In order to obtain a base paper as a sheet-form support having a PY value defined in the present invention, it is advantageously produced by adding a cationic compound and a cationic starch to a pulp slurry, then adding a sizing agent having an effect in the pH region from weak acid to weak alkaline pH, and finally an anionic compound.

As the pulp for use in the production of the base paper of the present invention, a natural pulp such as softwood pulp, hardwood tree pulp, synthetic pulp, or a mixed pulp of natural pulp and synthetic pulp can be used.

As the cationic compounds for use in the production of the base paper of the present invention, there can be used polyethyleneimine, polyethyleneimine-epichlorohydrin condensates, polyaminopolyamide epichlorohydrin resins, polyvinyl pyridine, styrene-dimethylaminoethyl methacrylate copolymers, cationic polyurethane resins, urea formaldehyde resins, melamine formaldehyde resins, dimethylamine picrolhydrin resins and the like.

As the cationic starches for use in the production of the base paper of the present invention, there can be mentioned those obtained by reacting starch with ethylimine, those obtained by reacting starch with polyalkylene polyamine, those obtained by reacting starch with an amine halide such as 2-dimethylaminoetyl chloride in an alkaline condition, those obtained by reacting starch with a quaternary ammonium such as 2,3-epoxypropyl trimethylammonium chloride in an alkaline condition and the like.

In accordance with the present invention, the content of the cationic starch in the base paper is preferably in the range of 0.1-2.0% by weight relative to the absolute dry weight of the pulp.

The sizing agents for use in the production of the base paper of the present invention are sizing agents that exhibit an effect in a paper-making system in a pH region from weak acid to weak alkali (pH5-9). As such sizing agents, there can be mentioned higher organic ketene dimers, substituted cyclic dicarboxylate anhydrides, epoxylated higher fatty acid amides and the like. They can be used alone or in combination of a few of them. In accordance with the present invention, the amount added of sizing agents in the base paper is preferably in the range of 0.1-2.0% by weight relative to the absolute dry weight of the pulp.

The anionic compounds for use in the production of the base paper of the present invention are partial hydrolyzates of polymers of acrylamide alone or of copolymers of copolymerizable vinyl monomers and acryl amide, or commonly used paper strength enhancers of anionic polyacrylamides such as copolymers of maleic acid, acrylic acid or salts thereof and acrylamide, and the like.

As needed, the base paper of the present invention may contain, in addition to the above cationic starches and sizing agents, various additives commonly used in paper making such as various wet paper strength enhancing agents, dry paper strength enhancing agents, anti-fogging agents, pigments, dyes, and yield enhancing agents.

Furthermore, as needed, the base paper may be subjected to surface treatment with starch, polyvinyl alcohol, gelatin etc. and antistatic treatment with Glauber's salt, sodium chloride, aluminum chloride etc.

In accordance with the present invention, hollow particles used in the intermediate layer are microcapsules formed from low-boiling point hydrocarbons such as n-butane, i-butane, pentane, neopentane or the like as the nucleus, and polymers of vinylidene chloride, acrylonitrile, methyl methacrylate or the like, alone or copolymers thereof, as the shell.

In accordance with the present invention, the hollow particles preferably have a mean particle size of 0.1 μm or more and 20 μm or less in the formed intermediate layer. The intermediate layer can be formed by a method in which, for example, prefoamed particles are used to prepare a coating for the intermediate layer and the intermediate layer is formed therefrom, or a method in which particles that are not prefoamed are used to prepare a coating for the intermediate layer, and after coating the intermediate layer, particles are foamed and the intermediate layer is formed therefrom. In said intermediate layer, if the mean particle size of the hollow particles exceeds 20 μm, smoothness may decrease resulting in deteriorated images. Also, if it is less than 0.1 μm, a sufficient insulating property may not be obtained resulting in reduced density of images.

As used herein the mean particle size of hollow particles may be measured using a particle size meter (trade name: SALD2000, manufactured by SHIMADZU SEISAKUSHO).

Also, the void volume of hollow particles is preferably 30% or more and 95% or less, and if the void volume is less than 30%, an insulating property becomes insufficient and a sufficient density may not be obtained. If it exceeds 95%, the thickness of the nucleus of hollow particles becomes thin, and hollow particles tend to be collapsed causing detrimental effects of reduced insulation etc. The void volume of hollow particles can be determined from the volume, specific gravity and solid density of the aqueous suspension of the hollow particles, and the true specific gravity of the resin constituting the hollow particle nucleus.

Furthermore, the mean particle size or void volume of hollow particles can also be determined from a photograph of the cross section of the intermediate layer using a small angle X-ray scattering meter (trade name: RU-200, manufactured by RIGAKU Corp.) etc.

In accordance with the present invention, as aqueous polymer compounds for use in the formation of the intermediate layer, commonly known water-soluble polymers and water-dispersible resins may be used. Among the water-soluble polymers, polyvinyl alcohol is preferred, and among the water-dispersible resins, an ethylene-vinyl acetate copolymer latex, an acrylic acid ester resin latex, a styrene-butadiene copolymer latex etc. are preferably used. The above aqueous polymer compounds may be used alone or in combination of two or more thereof.

In accordance with the present invention, the blending ratio of the hollow particles and the aqueous polymer compound that are constituting materials for the intermediate layer is preferably 10-300 parts by weight of the hollow particles relative to 100 parts by weight of the aqueous polymer compound. More preferably, it is 80-200 parts by weight. If the hollow particles are less than 10 parts by weight relative to 100 parts by weight of the aqueous polymer compound, a sufficient insulating property may not be obtained resulting in reduced density of printed images or deteriorated image quality. Also, if the hollow particles exceed 300 parts by weight relative to 100 parts by weight of the aqueous polymer compound, the strength of the coated film may decrease, and peeling of the coated film or cracking in the coated film may occur.

As materials constituting the intermediate layer, various inorganic and organic pigments, waxes, metal soap etc. can be used, and, as needed, various additives such as UV absorbing agents, fluorescent dyes, oil repellant agents, anti-foaming agents, viscosity controlling agents etc. can be used as long as they do not impair the desired effect.

The coating amount, in terms of solids in the intermediate layer, is preferably 1-50 g/m$^2$, and more preferably 5-20 g/m$^2$. If the coating amount in terms of solid of the intermediate layer is less than 1 g/m$^2$, a sufficient insulating or cushioning property may not be obtained to result in a reduced density of printed images or a deteriorated image quality. Also, if the coating amount in terms of solid exceeds 50 g/m$^2$, an insulating or cushioning effect may become saturated, and this is not preferred economically.

The film thickness of the intermediate layer, in order to exhibit the desired effects of insulation, cushioning etc., is preferably 20-90 μm, and more preferably 25-85 μm. If the film thickness of the intermediate layer is less than 20 μn, a sufficient insulating or cushioning property may not be obtained resulting in reduced density of printed images or deteriorated image quality. Also, if the film thickness exceeds 90 μm, an insulating or cushioning property may become saturated, and may be disadvantageous economically.

In forming the intermediate layer, coatings for the intermediate layer may be previously coated on molded surfaces, dried and then transferred to a sheet-form support in which, as the molded surfaces, those having dimensional stability and a highly smooth surface such as metal plates, metal drums and plastic films may be used. Also, as needed, in order to facilitate the release of the intermediate layer from the above molded surface, the molded surface may be coated with a releasing agent of a higher fatty acid such as calcium stearate and zinc stearate, a releasing agent of a polyethylene such as polyethylene emulsion, a releasing agent such as wax and silicone, and the like.

In accordance with the present invention, the calendering of the coated intermediate layer or the image receiving layer is effective for reducing unevenness on and smoothing the surface of the receiving sheet, and specifically calendering after coating the intermediate layer is more preferred. The calendering equipment, nip pressure, nip number, the surface temperature of the metal roll etc. used in calendering are not specifically limited, and a preferred pressure condition for calendering is, for example, 0.5-150 mPa and preferably 1-100 mPa. The temperature condition is preferably such that it is higher than room temperature, does not break hollow particles, and is higher than the Tg of the adhesive resin of the intermediate layer, and is, for example, 20-150° C., and more preferably 30-120° C. As the calendering equipment, calendering instruments commonly used in the paper-making industry can be used as appropriate, such as a supercalender, a soft calender and a gloss calender.

In accordance with the present invention, the receiving sheet is composed of an intermediate layer, a barrier layer and a receiving layer on the support in this order, and as the receiving layer, a known sublimation dye thermal transfer receiving layer can be applied. As the resin forming the receiving layer, a resin that has a high affinity with the dye transferred from the ink ribbon and that has a good dye-dyeable property can be used. As such a dye-dyeable resin, there can be used a polyester resin, a polycarbonate resin, a vinyl chloride copolymer, a polyvinyl acetal resin, a cellulose derivative resin such as cellulose acetate butyrate, an acrylic resin and the like.

Also, in order to prevent the fusing of the receiving layer and the ink ribbon due heating with the thermal head during printing, one or more of a crosslinking agent, a skid agent and a release agent is preferably added to the resin. Also, as needed, one or more of a fluorescent dye, a plasticizer, an antioxidant, a UV absorbing agent, a pigment etc. may be added. These additives may be mixed with components forming the receiving layer and coated, or they may be coated over and/or below the receiving layer as a separate coated layer.

The coating amount in terms of solid of the receiving layer is preferably about 1-15 g/m$^2$ and more preferably 3-10 g/m$^2$. If the coating amount in terms of solid of the receiving layer is less than 1 g/m$^2$, the receiving layer cannot completely coat the surface of the barrier layer, and deterioration of image quality or troubles of fusing the receiving layer and the ink ribbon due to heating with the thermal head during printing may occur. On the other hand, if the coating amount in terms of solid exceeds 15 g/m$^2$, the effect becomes saturated, which not only is uneconomical but results in insufficient strength of the coated film of the receiving layer, and insufficient insulating effect of the support due to increased thickness of the receiving layer, thereby leading to reduced density of the printed images.

As a method for forming the above coated layers such as the intermediate layer, the barrier layer and the receiving layer, various coating instruments such as an airknife coater, a Vari-Bar blade coater, a pure blade coater, a rod blade coater, a short dwell coater, a curtain coater, a die coater, a gravure coater, a roll coater, a spray coater, a dip coater, a bar coater, a comma coater, an offset roll coater, a reverse roll coater, a lip coater, a slide bead coater etc. can be used in order to coat each liquid for coating (also referred to as a coating liquid) prepared for the above preparation. When drying is needed, it can be carried out in a conventional method in combination with the above instrument for coating. Also, when curing with radiation is needed, radiation equipment such as a UV irradiation instrument, an electron beam irradiation instrument etc. can be used as appropriate for curing.

A preferred viscosity range of the coating liquid for the barrier layer is 20-200 mPa·sec. If the viscosity of the coating liquid for the barrier layer is less than 20 mPa·sec, problems of liquid dripping, defective application, cissing and the like may occur. On the other hand, if the viscosity of the coating liquid for the barrier layer exceeds 200 mPa·sec, problems of bar stripe, scratching or an excess amount of coating may arise.

For the purpose of preventing the penetration of the coating liquid for the intermediate layer into the support during the formation of the intermediate layer, a primer coating layer may be provided as needed to the receiving sheet of the present invention. Also, for the purpose of preventing the electrification of the receiving sheet, correcting the curling of the receiving sheet, preventing the superimposed travelling of the receiving sheet in the printer during image printing, and the like, a back surface layer may be provided to the back surface of the receiving sheet. It is also possible to effect supercalendering.

As described above, the receiving sheet of the present invention may be provided with a back surface layer on the back surface of the sheet-form support (the surface on the side opposite to the side on which the image receiving layer is provided). The back surface layer may comprise a resin effective as an adhesive as a principal component, and a crosslinking agent, a conducting agent, a fuse-adhesion preventing agent, an inorganic and/or organic pigment and the like.

For the back surface layer, as needed, a back surface layer-forming resin that is effective as an adhesive may be used. The resin is effective in enhancing adhesive strength between the back surface layer and the support, and print forwarding of the receiving sheet, preventing scratches on the image receiving layer, and preventing the travelling of the dye to the back surface layer in contact with the image receiving layer. As such a resin, there can be used an acrylic resin, an epoxy resin, a polyester resin, a phenol resin, a alkyd resin, an urethane resin, a melamine resin, a polyvinyl acetal resin and the like, and a cured product of these resins.

To the back surface layer of the present invention, in order to enhance adhesiveness between the sheet-form support and the back surface layer, a crosslinking agent such as a polyisocyanate compound and an epoxy compound may be blended to the coating for the back surface layer. The blending ratio is generally about 1-30% by weight relative to the total solid of the back surface layer.

To the back surface layer, in order to enhance print forwarding and prevent static electricity, a conductive agent such as a conductive polymer and a conductive inorganic pigment may be added. As a conductive polymer, there are cationic, anionic and nonionic conductive polymers, and as the cationic polymers, there can be mentioned, for example, polyethyleneimine, an acrylic copolymer containing cationic monomers, a cation-modified acrylamide polymer, a cationic starch and the like. Also, as an anionic polymer compound, there can be mentioned a polyacrylate, a polystyrene sulfonate, a styrene maleic acid copolymer and the like. The blending ratio of the conductive agent is preferably about 5-50% by weight relative to the total solid of the back surface layer. Also, as a conductive inorganic pigment, there can be mentioned a compound semiconductor pigment such as an oxide and/or a sulfide and an inorganic pigment in which the above compound semiconductor pigment has been coated, and the like. As a compound semiconductor, there can be illustrated a copper(I) oxide, zinc oxide, zinc sulfide, silicon carbide and the like. Also, as an inorganic pigment in which a compound semiconductor has been coated, there are titanium oxide and potassium titanate etc., and acicular and globular conductive inorganic pigments are commercially available.

To the back surface layer of the present invention, as needed, an organic or inorganic filler can be blended as a friction coefficient-adjusting agent. As an organic filler, a nylon filler, a cellulose filler, a urea resin filler, a styrene resin filler, an acrylic resin filler and the like can be used. As an inorganic filler, silica, barium sulfate, kaolin, clay, talc, ground calcium carbonate, precipitated calcium carbonate, titanium oxide, zinc oxide and the like can be used. In the case of a nylon filler, for example, the mean particle size is preferably about 1-15 μm, and the amount blended is preferably about 2-30% by weight relative to the total solid of the back surface layer, though this may vary with the particle size.

To the back surface layer of the present invention, as needed, a fuse-adhesion preventing agent such as a skid agent and a release agent may be incorporated. As the fuse-adhesion preventing agent, for example, a non-denatured and denatured silicone oil, a silicone compound such as a silicone block copolymer and a silicone rubber, a phosphate ester compound, a fatty acid ester compound, a fluorine compound and the like may be mentioned. Also, a conventionally known anti-foaming agent, a dispersing agent, a colored pigment, a fluorescence dye, a fluorescent pigment, an UV absorbing agent and the like may be selected as appropriate.

The coating amount, in terms of solids in the back surface layer is preferably in the range of 0.3-10 g/m$^2$. More preferably it is 1-8 g/m$^2$. If the coating amount in terms of solid of the back surface layer is less than 0.3 g/m$^2$, the effect of preventing scratches when the receiving sheet was scraped cannot be fully exhibited, and defective coating may occur resulting in a reduced surface electric resistance. On the other hand, if the coating amount in terms of solid of the back surface layer exceeds 10 g/m$^2$, the effect becomes saturated and is uneconomical.

Furthermore, in the receiving sheet of the present invention, the support may have an adhesive layer at the side opposite to the receiving layer, and the above adhesive layer side and the release layer side of the release sheet having a release layer comprising a release agent may be laminated so as to face each other. Thus, it may have a constitution in which an intermediate layer, a barrier layer, a receiving layer etc. are sequentially laminated on one side of the support, and furthermore on the other side of the support an adhesive layer, a release layer, and a release sheet substrate (as used herein, the release sheet substrate having a release layer is sometimes referred to as a "release sheet") are sequentially laminated. In the receiving sheet of this constitution, the adhesive layer and the release layer can adhere to or release from each other, and thus it is a receiving sheet of the so-called seal type or label type (hereinafter referred to as the "seal type"). Thus, in a further embodiment, the present invention provides a receiving sheet of the seal type.

As the receiving sheet of the seal type, the total thickness is preferably 100-300 μm. If the thickness is less than 100 μm, the mechanical strength, stiffness etc. of the receiving sheet is insufficient, and the curling of the receiving sheet during printing may not be fully prevented. Also, if the thickness exceeds 300 μm, such problems may arise that the number of the receiving sheets that can be accommodated into the printer is reduced, or the miniaturizing the printer becomes difficult to accommodate a given number of sheets because an enhanced volume of the accommodating part, for the receiving sheet, is needed.

In accordance with the receiving sheet of the seal type of the present invention, resins for use in adhesive agents include, for example, known adhesive agents such as acrylic, rubber, or silicone resins etc. Among these resins for adhesive agents, the acrylic resins are most preferably used. As the acrylic resins, those resins obtained by copolymerizing 2-ethylhexyl acrylate, butyl acrylate, ethyl acrylate or the like as the principal component with one or more of other (meth) acrylic esters (nonfunctional (meth)acrylic esters and (meth) acrylic esters having various functional groups) or furthermore other copolymerizable monomers etc are preferably used. To these resins for adhesive agents, various tackifiers such as rosin, crosslinking agents of the isocyanate or epoxy, age resisters, stabilizers, softeners such as an oil, a filler, a pigment, a dye etc. can also be added as needed. Two or more of them may be used in combination as needed.

Also, the coating amount in terms of solid of the adhesive layer is preferably 5-30 g/m$^2$, and more preferably 7-25 g/m$^2$. The adhesive layer may be formed by coating a coating solution for the adhesive layer according to a standard method using a coater selected from the group consisting of a bar coater, a gravure coater, a comma coater, a blade coater, an airknife coater, a die coater, a curtain coater, a lip coater, and a slide coater, and then by drying.

The sequence of forming the adhesive layer is: the coating solution for the adhesive layer is coated on the surface of a release layer provided on the release sheet substrate, and dried to form the adhesive layer, and then the adhesive layer side and the side of the support having the receiving layer on the surface are laminated and stuck to face to each other, or the coating solution for the adhesive layer is coated on the opposite surface of the support having the receiving layer, and dried to form the adhesive layer, and then the adhesive layer side and the release layer side of the release sheet are laminated and stuck to face each other.

As the release sheet substrate for use in the receiving sheet of the seal type of the present invention, a substrate similar to the support of the above receiving sheet may be used. Among them, a laminated paper having a thermoplastic resin layer such as a polyolefin resin provided on at least one side thereof, a glassine paper, a supercalendered paper, or an aqueous resin coated paper in which a coated layer comprising a water-soluble resin such as polyvinyl alcohol or starch (a pigment such as clay may be blended as needed) has been provided on a paper such as a wood-free paper, kraft paper or the like, or a film comprising a synthetic resin such as polyester (for example polyethylene terephthalate) as a principal component, are preferably used. The thickness of the release sheet substrate is preferably in the range of 20-200 μm and more preferably 50-150 μm.

In accordance with the present invention, as the release sheet being subjected to the releasing treatment, there can be used, for example, those having a release layer on the release sheet substrate and, in the above release layer, a known releasing agent may be incorporated. As a releasing agent, a silicone resin, a fluorine resin or the like of the emulsion type, the solvent type or the nonsolvent type is preferably used. In this case, the coating liquid for the release layer is coated on the above release sheet substrate so that the coating amount in terms of solid of the release layer is preferably 0.1-3 g/m$^2$, and more preferably 0.3-1.5 g/m$^2$, and then after drying, thermally cured or cured by UV irradiation etc. to form the release layer. The method of forming the release layer is not specifically limited, and for example a coater such as a bar coater, a direct gravure coater, an offset gravure coater and an airknife coater is used as appropriate to coat the coating liquid for the release layer on the release sheet substrate and dried to form the release layer.

In the receiving sheet of the seal type, the back surface layer may be provided on the surface of the side opposite to the side on which a release layer of the release sheet substrate has been provided. The back surface layer of the release sheet substrate may be formed in a similar manner to the back surface layer of the above receiving sheet, and the formation of the back surface layer of the receiving sheet is omitted.

EXAMPLES

The present invention will now be explained in detail with reference to Examples, but it should be noted that the present invention is not limited to these examples in any way. Unless otherwise specified, "parts" and "%" in the Examples refer to "parts by weight" and "% by weight", respectively.

Example 1

(Formation of the Coated Sheet of the Intermediate Layer)

Seventy parts of an aqueous dispersion (solid concentration: 30%) of foamed hollow particles (mean particle size: 5.4 μm, void volume: 60%) comprising a therplastic resin containing vinylidene chloride and acetonitrile as the principal components, 15 parts of an aqueous solution (solid concentration: 10%) of polyvinyl alcohol (trade name: PVA217, manufactured by KURARAY), and 15 parts of a styrene-butadiene latex (trade name: L-1537, solid concentration: 50%, manufactured by ASAHIKASEI) were mixed and stirred to prepare a coating solution for the intermediate layer. Then, one side of an art paper (trade name: OK Kondo N, basis weight: 186 g/m$^2$, manufactured by OJI PAPER) as the support was coated using a die coater so that the amount coated after drying is 20 g/m$^2$ and dried to form a coated sheet for the intermediate layer. The PY value of the surface of the art paper used as the support at wavelengths of 1-12.5 mm was 85 mV.

(Formation of the Coated Sheet for the Barrier Layer)

One hundred parts of an aqueous solution (solid concentration: 10%) of an ethylene-vinyl alcohol copolymer (trade name: RS4103, the degree of polymerization: 300, manufactured by KURARAY) and 50 parts of an aqueous solution (solid concentration: 10%) of a styrene-acrylic copolymer (trade name: Polymalon 326, Tg: 50° C., manufactured by ARAKAWA KAGAKUKOGYO K.K.) were mixed and stirred to prepare a coating solution for the barrier layer. Then, on the intermediate layer of the above intermediate layer coated sheet, the coating solution for the barrier layer was coated using a Mayer bar coater so that the coating amount after drying will be 3 g/m$^2$, and dried to form the coated sheet for the barrier layer.

(Formation of the Coated Sheet for the Back Surface Layer)

One hundred parts of an aqueous solution (solid concentration: 10%) of polyvinyl alcohol (trade name: PVA117, manufactured by KURARAY) and 20 parts of zinc stearate (trade name: Z-8-36, solid concentration: 30%, manufactured by CHUKYOYUSHI) were mixed and stirred to prepare a coating solution for the back surface layer. Then, to the back surface of the above barrier layer coated sheet, the coating liquid for the back surface layer was coated so that the coating amount after drying will be 2 g/m$^2$, and then dried to form a back surface layer coated sheet.

(Formation of the Receiving Sheet)

One hundred parts of a polyester resin (trade name: Vylon 200, manufactured by TOYOBO), two parts of a silicone oil (trade name: KF393, manufactured by SHIN-ETSU CHEMICAL), and 6 parts of an isocyanate compound (trade name: Takenate D-110N, manufactured by MITSUI TAKEDA CHEMICALS) were dissolved in 200 parts of a mixed solvent of toluene/methylethyl ketone=1/1 (weight ratio), mixed and stirred to prepare a coating solution for the receiving layer. Then, the coating solution for the receiving layer was coated on the barrier layer of the above back surface layer coated sheet using a gravure coater so that the coating amount after drying will be 6 g/m$^2$, and then dried to form the receiving sheet.

Subsequently, the receiving sheet was aged at 50° C. for 48 hours. Furthermore, using a calender the surface of the receiving layer was subjected to a smoothing treatment (the roll surface temperature: 78° C., nip pressure: 2.5 MPa).

Example 2

A receiving sheet was formed in a similar manner to Example 1, except that the preparation of the coating solution for the barrier layer was changed as described below in the formation of the coated sheet for the barrier layer in Example 1.

(Preparation of the Coating Solution for the Barrier Layer)

One hundred parts of an aqueous solution (solid concentration: 10%) of an ethylene-vinyl alcohol copolymer (trade name: RS4103, the degree of polymerization: 300, manufactured by KURARAY) and 150 parts of an aqueous solution (solid concentration: 10%) of a styrene-acrylic copolymer (trade name: Polymalon 326, Tg: 50° C., manufactured by ARAKAWA KAGAKUKOGYO K.K.) were mixed and stirred to prepare a coating solution for the barrier layer.

Example 3

A receiving sheet was formed in a similar manner to Example 1, except that the preparation of the coating solution for the barrier layer was changed as described below in the formation of the coated sheet for the barrier layer in Example 1.

(Preparation of the Coating Solution for the Barrier Layer)

One hundred parts of an aqueous solution (solid concentration: 10%) of an ethylene-vinyl alcohol copolymer (trade name: RS4105, the degree of polymerization: 500, manufactured by KURARAY) and 100 parts of an aqueous solution (solid concentration: 10%) of a styrene-maleic acid copolymer (trade name: Polymalon 1318, Tg: 70° C., manufactured by ARAKAWA KAGAKUKOGYO K.K.) were mixed and stirred to prepare a coating solution for the barrier layer.

Example 4

A receiving sheet was formed in a similar manner to Example 1, except that the preparation of the coating solution for the barrier layer was changed as described below in the formation of the coated sheet for the barrier layer in Example 1.

(Preparation of the Coating Liquid for the Barrier Layer)

One hundred parts of an aqueous solution (solid concentration: 10%) of an ethylene-vinyl alcohol copolymer (trade name: HR3010, manufactured by KURARAY) and 100 parts of an aqueous solution (solid concentration: 10%) of an acrylic acid ester copolymer (trade name: AT613, Tg: 60° C., manufactured by NIHON JUNYAKU) were mixed and stirred to prepare a coating solution for the barrier layer.

Example 5

A receiving sheet was formed in a similar manner to Example 1, except that the preparation of the coating solution for the barrier layer was changed as described below in the formation of the coated sheet for the barrier layer in Example 1.

(Preparation of the Coating Solution for the Barrier Layer)

One hundred parts of an aqueous solution (solid concentration: 10%) of an ethylene-vinyl alcohol copolymer (trade name: RS4103, the degree of polymerization: 300, manufactured by KURARAY) and 100 parts of an aqueous dispersion (solid concentration: 10%) of a polyester resin (trade name: MD1500, Tg: 70° C., manufactured by TOYOBO) were mixed and stirred to prepare a coating solution for the barrier layer.

Example 6

A receiving sheet was formed in a similar manner to Example 1, except that the preparation of the coating solution for the barrier layer was changed as described below in the formation of the coated sheet for the barrier layer in Example 1.

(Preparation of the Coating Solution for the Barrier Layer)

One hundred parts of an aqueous solution (solid concentration: 10%) of an ethylene-vinyl alcohol copolymer (trade name: RS4103, the degree of polymerization: 300, manufactured by KURARAY) and 100 parts of an aqueous dispersion (solid concentration: 10%) of a polyurethane resin (trade name: UX125, Tg: 105° C., manufactured by ASAHIDENKA) were mixed and stirred to prepare a coating solution for the barrier layer.

Example 7

A receiving sheet was formed in a similar manner to Example 1, except that the steps of preparing the coating solution for the barrier layer and drying the coating were changed as described below in the formation of the coated sheet for the barrier layer in Example 1.

(Preparation of the Coating Solution for the Barrier Layer)

One hundred parts of an aqueous solution (solid concentration: 10%) of a fully saponified PVA resin (trade name: PVA110, the degree of saponification: 99%, the degree of polymerization: 1000, manufactured by KURARAY) and 100 parts of an aqueous solution (solid concentration: 10%) of a styrene-acrylic copolymer (trade name: Polymalon 326, Tg: 50° C., manufactured by ARAKAWA KAGAKUKOGYO K.K.) were mixed and stirred to prepare a coating solution for the barrier layer.

Then, on the intermediate layer of the above intermediate layer coated sheet, the coating liquid for the barrier layer was coated using a Mayer bar coater so that the amount coated after drying is 2 g/m$^2$, and dried to form the coated sheet for the barrier layer.

Example 8

A receiving sheet was formed in a similar manner to Example 7, except that the preparation of the coating solution for the barrier layer was changed as described below in the formation of the coated sheet for the barrier layer in Example 7.

(Preparation of the Coating Solution for the Barrier Layer)

One hundred parts of an aqueous solution (solid concentration: 10%) of a fully saponified PVA resin (trade name: PVA110, the degree of saponification: 99%, the degree of polymerization: 1000, manufactured by KURARAY) and 100 parts of an aqueous solution (solid concentration: 10%) of a styrene-acrylic copolymer (trade name: Polymalon 300D, Tg: 74° C., manufactured by ARAKAWA KAGAKUKOGYO K.K.) were mixed and stirred to prepare a coating solution for the barrier layer.

Example 9

A receiving sheet was formed in a similar manner to Example 7, except that the preparation of the coating solution for the barrier layer was changed as described below in the formation of the coated sheet for the barrier layer in Example 7.

(Preparation of the Coating Solution for the Barrier Layer)

One hundred parts of an aqueous solution (solid concentration: 10%) of a fully saponified PVA resin (trade name: PVA110, the degree of saponification: 99%, the degree of polymerization: 1000, manufactured by KURARAY) and 100 parts of an aqueous solution (solid concentration: 10%) of an acrylic ester copolymer (trade name: Joncryl 501, Tg:

65° C., manufactured by JOHNSON POLYMER) were mixed and stirred to prepare a coating solution for the barrier layer.

Example 10

A receiving sheet was formed in a similar manner to Example 7, except that the preparation of the coating liquid for the barrier layer was changed as described below in the formation of the coated sheet for the barrier layer in Example 7.

(Preparation of the Coating Solution for the Barrier Layer)

One hundred parts of an aqueous solution (solid concentration: 10%) of a fully saponified PVA resin (trade name: PVA110, the degree of saponification: 99%, the degree of polymerization: 1000, manufactured by KURARAY) and 100 parts of an aqueous dispersion (solid concentration: 10%) of a polyester resin (trade name: MD1500, Tg: 70° C., manufactured by TOYOBO) were mixed and stirred to prepare a coating solution for the barrier layer.

Example 11

A receiving sheet was formed in a similar manner to Example 7, except that the preparation of the coating solution for the barrier layer was changed as described below in the formation of the coated sheet for the barrier layer in Example 7.

(Preparation of the Coating Liquid for the Barrier Layer)

One hundred parts of an aqueous solution (solid concentration: 10%) of a fully saponified PVA resin (trade name: PVA103, the degree of saponification: 99%, the degree of polymerization: 300, manufactured by KURARAY) and 100 parts of a styrene-acrylic copolymer (trade name: Polymalon 326, Tg: 50° C., manufactured by ARAKAWA KAGAKUKOGYO K.K.) were mixed and stirred to prepare a coating solution for the barrier layer.

Example 12

A receiving sheet was formed in a similar manner to Working Example 7, except that the preparation of the coating liquid for the barrier layer was changed as described below in the formation of the coated sheet for the barrier layer in Example 7.

(Preparation of the Coating Solution for the Barrier Layer)

One hundred parts of an aqueous solution (solid concentration: 10%) of a partially saponified PVA resin (trade name: PVA210, the degree of saponification: 88%, the degree of polymerization: 1000, manufactured by KURARAY) and 100 parts of an aqueous solution (solid concentration: 10%) of a styrene-acrylic copolymer (trade name: Polymalon 326, Tg: 50° C., manufactured by ARAKAWA KAGAKUKOGYO K.K.) were mixed and stirred to prepare a coating solution for the barrier layer.

Example 13

A receiving sheet was formed in a similar manner to Example 7, except that the preparation of the coating liquid for the barrier layer was changed as described below in the formation of the coated sheet for the barrier layer in Example 7.

(Preparation of the Coating Solution for the Barrier Layer)

One hundred parts of an aqueous solution (solid concentration: 10%) of a fully saponified PVA resin (trade name: PVA110, the degree of saponification: 99%, the degree of polymerization: 1000, manufactured by KURARAY) and 54 parts of an aqueous solution (solid concentration: 10%) of a styrene-acrylic copolymer (trade name: Polymalon 326, Tg: 50° C., manufactured by ARAKAWA KAGAKUKOGYO K.K.) were mixed and stirred to prepare a coating solution for the barrier layer.

Example 14

A receiving sheet was formed in a similar manner to Example 7, except that the preparation of the coating solution for the barrier layer was changed as described below in the formation of the coated sheet for the barrier layer in Example 7.

(Preparation of the Coating Solution for the Barrier Layer)

One hundred parts of an aqueous solution (solid concentration: 10%) of a fully saponified PVA resin (trade name: PVA110, the degree of saponification: 99%, the degree of polymerization: 1000, manufactured by KURARAY) and 150 parts of an aqueous solution (solid concentration: 10%) of a styrene-acrylic copolymer (trade name: Polymalon 326, Tg: 50° C., manufactured by ARAKAWA KAGAKUKOGYO K.K.) were mixed and stirred to prepare a coating solution for the barrier layer.

Example 15

A receiving sheet was formed in a similar manner to Example 7, except that the preparation of the coating solution for the barrier layer was changed as described below in the formation of the coated sheet for the barrier layer in Example 7.

(Preparation of the Coating Solution for the Barrier Layer)

One hundred parts of an aqueous solution (solid concentration: 10%) of a silanol-modified PVA resin (trade name: PVA R-1130, the degree of saponification: 99%, the degree of polymerization: 1700, manufactured by KURARAY) and 100 parts of an aqueous solution (solid concentration: 10%) of a styrene-maleic acid copolymer (trade name: Polymalon WR300D, Tg: 74° C., manufactured by ARAKAWA KAGAKUKOGYO K.K.) were mixed and stirred to prepare a coating solution for the barrier layer.

Example 16

A receiving sheet was formed in a similar manner to Example 7, except that the preparation of the coating solution for the barrier layer was changed as described below in the formation of the coated sheet for the barrier layer in Example 7.

(Preparation of the Coating Solution for the Barrier Layer)

One hundred parts of an aqueous solution (solid concentration: 10%) of a silanol-modified PVA resin (trade name: PVA R-2105, the degree of saponification: 99%, the degree of polymerization: 500, manufactured by KURARAY) and 100 parts of a styrene-acrylic copolymer (trade name: Polymalon 326, Tg: 50° C., manufactured by ARAKAWA KAGAKUKOGYO K.K.) were mixed and stirred to prepare a coating solution for the barrier layer.

Comparative Example 1

A receiving sheet was formed in a similar manner to Example 1, except that the preparation of the coating solution for the barrier layer was changed as described below in the formation of the coated sheet for the barrier layer in Example 1.

(Preparation of the Coating Solution for the Barrier Layer)

An aqueous solution (solid concentration: 10%) of an ethylene-vinyl alcohol copolymer (trade name: RS4103, the degree of polymerization: 300, manufactured by KURARAY) was used as a coating solution for the barrier layer.

Comparative Example 2

A receiving sheet was formed in a similar manner to Example 1, except that the preparation of the coating solution for the barrier layer was changed as described below in the formation of the coated sheet for the barrier layer in Example 1.

(Preparation of the Coating Solution for the Barrier Layer)

An aqueous solution (solid concentration: 10%) of a fully saponified PVA resin (trade name: PVA110, the degree of saponification: 99%, the degree of polymerization: 1000, manufactured by KURARAY) was used as the coating solution for the barrier layer.

Comparative Example 3

A receiving sheet was formed in a similar manner to Example 1, except that the preparation of the coating solution for the barrier layer was changed as described below in the formation of the coated sheet for the barrier layer in Example 1.

(Preparation of the Coating Solution for the Barrier Layer)

An aqueous solution (solid concentration: 10%) of a styrene-acrylic copolymer (trade name: Polymalon 326, Tg: 50° C., manufactured by ARAKAWA KAGAKUKOGYO K.K.) was used as the coating solution for the barrier layer.

Comparative Example 4

A receiving sheet was formed in a similar manner to Example 1, except that a barrier layer was not provided in between the intermediate layer and the receiving layer in Example 1.

Comparative Example 5

A receiving sheet was formed in a similar manner to Example 7, except that the preparation of the coating solution for the barrier layer was changed as described below in the formation of the coated sheet for the barrier layer in Example 7.

(Preparation of the Coating Solution for the Barrier Layer)

One hundred parts of an aqueous solution (solid concentration: 10%) of a fully saponified PVA resin (trade name: PVA110, the degree of saponification: 99%, the degree of polymerization: 1000, manufactured by KURARAY) and 100 parts of a water dispersion of a styrene-butadiene copolymer (trade name: Nipol LX430, Tg: 12° C., manufactured by ZEON CORPORATION) were mixed and stirred to prepare a coating solution for the barrier layer.

Example 17

(Formation of the Receiving Sheet Part)

A coated sheet for the intermediate layer was formed in a similar manner to Example 1, except that the art paper (trade name: OK Kondo N, basis weight: 186 g/m$^2$, manufactured by OJI PAPER) as the support was replaced with an art paper (trade name: OK Kondo N, basis weight: 104.7 g/m$^2$, manufactured by OJI PAPER) in "Formation of the coated sheet of the intermediate layer" of Example 1. The PY value of the surface of the art paper used as the support at wavelengths of 1-12.5 mm was 80 mV.

Subsequently, on the intermediate layer of the above coated sheet of the intermediate layer, a coated sheet for the barrier layer was formed by using a coating solution for the barrier layer prepared in Example 7 so that the coating amount after drying will be 2 g/m$^2$, and in a similar manner to the formation of the receiving sheet of Example 1, a receiving sheet part was formed by forming a receiving layer on the barrier layer. However, the formation of the back surface layer was omitted.

(Formation of the Release Sheet Substrate)

On both sides of a quality paper (trade name: OK quality paper, basis weight: 52.3 g/m$^2$, manufactured by OJI PAPER) with a thickness of 67 μm, a titanium dioxide-blended low density polyethylene (trade name: Yukalon LK50, manufactured by MITSUBISHI CHEMICAL CORPORATION) was coated by melt extrusion to 20 μm each to obtain a release sheet substrate.

(Formation of the Release Sheet)

On one side of the release sheet substrate obtained as above, a silicone releasing agent (trade name: KS830, manufactured by SHIN-ETSU CHEMICAL) was coated using a gravure coater so that the coating amount after drying will be 0.5 g/m$^2$, and dried to form a release sheet.

(Formation of the Back Surface Layer-Coated Release Sheet)

Subsequently, on the side on which the above release layer of the release sheet has not been provided, a coating solution prepared in Example 1 was coated so that the coating amount after drying will be 2 g/m$^2$, and dried to form a back surface layer-coated release sheet.

(Formation of a Seal Type Receiving Sheet)

Four hundred parts of an acrylic adhesive agent (trade name: PE115E, solid concentration: 23%, manufactured by NIPPON CARBIDE INDUSTRIES), 3 parts of a curing agent (trade name: CK101, solid concentration: 75%, manufactured by NIPPON CARBIDE INDUSTRIES), and 80 parts of ethyl acetate were mixed and stirred to prepare a coating solution for the adhesive layer. Then, on the release layer of the above the back surface layer-coated release sheet, the above coating solution for the adhesive layer was coated so that the coating amount after drying will be 15 g/m$^2$, and dried to form a adhesive layer-coated release sheet.

Subsequently, the adhesive layer side of the above adhesive layer-coated release sheet and the support side (the opposite side to the receiving layer) of the above receiving sheet part were superimposed and adhesion-laminated to form a seal type receiving sheet.

Example 18

A seal type receiving sheet was formed in a similar manner to Example 17 except that the coating solution for the barrier layer prepared in Example 8 was used.

Example 19

A seal type receiving sheet was formed in a similar manner to Example 17 except that the coating solution for the barrier layer prepared in Example 9 was used.

Example 20

A seal type receiving sheet was formed in a similar manner to Example 17 except that the coating solution for the barrier layer prepared in Example 13 was used.

Examples 21-23 and Reference Example 1

A seal type receiving sheet was formed in a similar manner to Example 7 except that a seat-form support formed in a manner described below was used.

"Formation of a Sheet-Form Support"

(1) Production of a Base Paper

To 100 parts of bleached kraft pulp of a broad leaf tree (LBKP) that was beaten in water at a temperature of 20° C. to a Canadian Standard Freeness of 300 CC, 0.3 part of polyamide polyamine epichlorohydrin (trade name: WS-525, manufactured by NIPPON PMC), 1.0 part of baking soda, 1.0 part of an alkylketene dimer sizing agent (trade name: SPK903, manufactured by ARAKAWA KAGAKUKOGYO K.K.), 1.2 part of a cationic starch (trade name: Cato-2, manufactured by NIPPON NSC) and 0.4 part of polyacrylamide (trade name: Polystron 117, manufactured by NIPPON NSC) were added in the order shown in Table 1. From the pulp slurry obtained, a base paper with a basis weight of 150 g/m$^2$ was produced.

(2) Formation of the Sheet-Form Support

With this base paper in a size press, a 5% sizing liquid prepared by dissolving a carboxyl group-denatured PVA and sodium chloride at a weight ratio of 2:1 was coated to a coating amount of 1.5 g/m$^2$ (after drying), and dried to obtain a sheet-form support.

TABLE 1

| | Addition sequence | | | | |
|---|---|---|---|---|---|
| | Polyamide polyamine epichloro-hydrin | Alkylketene dimer | Cationic starch | Polyacryl amide | Support PY value (mV) |
| Ex. 21 | 1 | 2 | 3 | 4 | 90 |
| Ex. 22 | 1 | 3 | 2 | 4 | 120 |
| Ex. 23 | 2 | 3 | 1 | 4 | 140 |
| Ref. Ex. 1 | 3 | 3 | 4 | 1 | 160 |

Evaluation

The receiving sheets obtained in the above Examples and Comparative Examples were each evaluated according to the following methods, and the results obtained are shown in Table 2. In Table 2, relative to the seal-type receiving sheets of Examples 17-20, the receiving sheets of Examples 1-16 and 21-23 and Comparative Examples 1-5 and Reference Example 1 are referred to as the STD-type (standard) receiving sheet.

Measurement of "Coating Viscosity"

The viscosity of the coating solution for the barrier layer was measured using a type B viscometer (manufactured by TOKIMEC) according to the attached instructions.

Evaluation of "Print Quality" (Print Density, Image Evenness)

Using a commercially available thermal transfer video printer (trade name: UP-DR100, manufactured by SONY) and using an ink ribbon in which an ink layer containing subliming dyes of three different colors of yellow, magenta and cyan together with a binder has been provided on a polyester film with a thickness of 6 μm, the ink layer side of each color was brought into contact with the test receiving sheet, and was subjected to heating that was controlled stepwise by the thermal head to thermally transfer the predetermined images to the receiving sheet and to print images of mono-colors or superimposed colors of medium tones of each color. For the recorded images by the energy applied that were transferred on the receiving sheet, the reflection density was measured using a Macbeth reflection densitometer (trade name: RD-914, manufactured by Kollmorgen). The density of the high gradation region corresponding to the 15th step from the bottom of the energy applied is shown as the printed image density in Table 2.

Furthermore, the evenness of the recorded images of the gradation part of which optical density (black) corresponds to 0.3 was visually evaluated for the presence or absence of uneven density and white spots. Those with a good evaluation result are indicted by "good", those with a moderate evaluation result by "fair", and those with conspicuous uneven density and white spots by "poor".

Evaluation of "Retaining Property after Drying" (Blurring in Images)

Using a commercially available thermal transfer video printer (trade name: UP-DR100, manufactured by SONY), an ink ribbon in which an ink layer containing subliming dyes of three different colors of yellow, magenta and cyan together with a binder has been provided on a polyester film with a thickness of 6 μm was sequentially brought into contact with the receiving sheet, and was subjected to heating that was controlled stepwise by the thermal head to thermally transfer the predetermined images to the receiving sheet and to print images of black and blue thin lines. Then, as an acceleration test on retaining property after image printing, image-printed sheets were allowed to stand in an environment of a temperature of 50° C. and a relative humidity of 95%. The percentage of blurring in images was calculated according to the following equation (1):

$$\text{The ratio of blurring} = \frac{(\text{Thickness of thin line after standing}) \times 100}{(\text{Thickness of thin line before standing})} \quad (1)$$

The ratio of blurring less than 110% was evaluated as "good", 110% or greater and less than 130% as "fair", and 130% or greater as "poor".

Evaluating of "Bending Cracks"

The occurrence of cracking of the image-printed surface when the receiving sheet is bent was visually evaluated according to the following criteria:

good: Good with no occurrence of bending cracks fair: Occurrence of slight bending cracks poor: Occurrence of bending cracks deteriorating the commercial value Evaluation of the "PY Value"

Samples were taken at 30 cm (MD direction)×5 cm (CD direction), and the unevenness in thickness of the sample was measured by a film thickness meter (manufactured by ANRITSU), and then the measured signal obtained was analyzed by a frequency analyzer (manufactured by ONO SOKKI).

The film thickness meter and its measuring condition are as follows:

Film transport (manufactured by ANRITSU): Film transport speed set at 25 mm/sec, Metal ball with a ball diameter of 5 mm, pressure 36 g/tip, Micrometer K-306C (manufactured by ANRITSU): Sensitivity range +/−50 μm, Recorder K-310B (manufactured by ANRITSU): Sensitivity range 0.5 V/cm.

Also, the frequency analyzer and its analytical condition are as follows:

Frequency analyzer (manufactured by ONO SOKKI): CF-940, input signal DC5V, 1K (1,024 points)/dual The integral (PY value) of the power spectrum at wavelengths of 1-12.5 mm obtained from the above measuring condition was measured.

TABLE 2

| | | Barrier layer coating viscosity (mPa · sec) | Printed image density | Image evenness | Image blurring | Bending cracks |
|---|---|---|---|---|---|---|
| STD type receiving sheet | Ex. 1 | 30 | 2.45 | good | good | good |
| | Ex. 2 | 100 | 2.42 | good | good | good |
| | Ex. 3 | 80 | 2.41 | good | good | good |
| | Ex. 4 | 70 | 2.44 | good | good | good |
| | Ex. 5 | 40 | 2.47 | good | good | good |
| | Ex. 6 | 90 | 2.41 | good | good | good |
| | Ex. 7 | 90 | 2.44 | good | good | good |
| | Ex. 8 | 70 | 2.43 | good | good | good |
| | Ex. 9 | 80 | 2.42 | good | good | good |
| | Ex. 10 | 60 | 2.43 | good | good | good |
| | Ex. 11 | 50 | 2.44 | good | good | good |
| | Ex. 12 | 80 | 2.42 | good | good | good |
| | Ex. 13 | 90 | 2.42 | good | good | good |
| | Ex. 14 | 90 | 2.44 | good | good | good |
| | Ex. 15 | 120 | 2.43 | good | good | good |
| | Ex. 16 | 60 | 2.42 | good | good | good |
| | Com. Ex. 1 | 20 | 2.45 | good | poor | good |
| | Com. Ex. 2 | 90 | 2.41 | good | poor | good |
| | Com. Ex. 3 | 90 | 2.41 | good | good | poor |
| | Com. Ex. 4 | — | 2.45 | poor | poor | poor |
| | Com. Ex. 5 | 40 | 2.41 | good | good | good |
| Seal type receiving sheet | Ex. 17 | 90 | 2.44 | good | good | good |
| | Ex. 18 | 70 | 2.43 | good | good | good |
| | Ex. 19 | 80 | 2.42 | good | good | good |
| | Ex. 20 | 90 | 2.42 | good | good | good |
| STD type receiving sheet | Ex. 21 | 90 | 2.47 | good | good | good |
| | Ex. 22 | 90 | 2.46 | good | good | good |
| | Ex. 23 | 90 | 2.45 | good | good | good |
| | Ref. Ex. 1 | 90 | 2.41 | fair | good | good |

INDUSTRIAL APPLICABILITY

The receiving sheet of the present invention is of a high image quality, has a high image retaining property free of blurring in printed images over time, and cracking on the printed surface by bending will not easily occur, is inexpensive and is practically very valuable.

What is claimed is:

1. A thermal transfer receiving sheet having laminated, on one side of its support, an intermediate layer, a barrier layer and an image receiving layer in this order, wherein said intermediate layer comprises hollow particles, and said barrier layer comprises a polyvinyl alcohol derivative, and comprises, as further main components, a resin or a mixture of two or more resins selected from the group consisting of a styrene-maleic acid copolymer, a styrene-acrylic copolymer, an acrylic acid ester polymer and polyester.

2. The thermal transfer receiving sheet according to claim 1 wherein the glass transition temperature (Tg) of the above resin or a mixture of two or more resins selected from the group consisting of a styrene-maleic acid copolymer, a styrene-acrylic copolymer, an acrylic acid ester polymer and polyester is 45° C. or higher and 120° C. or lower.

3. The thermal transfer receiving sheet according to claim 2 wherein the ratio of the above resin or a mixture of two or more resins selected from the group consisting of a styrene-maleic acid copolymer, a styrene-acrylic copolymer, an acrylic acid ester polymer and polyester is 30-300 parts by weight relative to 100 parts by weight of the polyvinyl alcohol derivative in said barrier layer.

4. The thermal transfer receiving sheet according to claim 3 wherein the above polyvinyl alcohol derivative is a resin or a mixture of two or more resins selected from the group consisting of a fully saponified polyvinyl alcohol, a partially saponified polyvinyl alcohol, a silanol-modified polyvinyl alcohol and an ethylene vinyl alcohol copolymer.

5. The thermal transfer receiving sheet according to claim 4 wherein said support has an adhesive layer on the other side of the image receiving layer and wherein said adhesive layer side and the release layer side of the release sheet having a release layer containing a release agent have been laminated to face each other.

6. The thermal transfer receiving sheet according to claim 5 wherein the integral (PY value) of the power spectrum at wavelengths of 1-12.5 mm of said support surface is 150 mV or less.

7. The thermal transfer receiving sheet according to claim 1 wherein the ratio of the above resin or a mixture of two or more resins selected from the group consisting of a styrene-maleic acid copolymer, a styrene-acrylic copolymer, an acrylic acid ester polymer and polyester is 30-300 parts by weight relative to 100 parts by weight of the polyvinyl alcohol derivative in said barrier layer.

8. The thermal transfer receiving sheet according to claim 7 wherein the above polyvinyl alcohol derivative is a resin or a mixture of two or more resins selected from the group consisting of a fully saponified polyvinyl alcohol, a partially saponified polyvinyl alcohol, a silanol-modified polyvinyl alcohol and an ethylene vinyl alcohol copolymer.

9. The thermal transfer receiving sheet according to claim 1 wherein the above polyvinyl alcohol derivative is a resin or a mixture of two or more resins selected from the group consisting of a fully saponified polyvinyl alcohol, a partially saponified polyvinyl alcohol, a silanol-modified polyvinyl alcohol and an ethylene vinyl alcohol copolymer.

10. The thermal transfer receiving sheet according to claim 9 wherein the mean particle size of the above hollow particles is 0.1 mm or greater and 20 mm or smaller.

11. The thermal transfer receiving sheet according to claim 9 wherein said support has an adhesive layer on the other side of the image receiving layer and wherein said adhesive layer side and the release layer side of the release sheet having a release layer containing a release agent have been laminated to face each other.

12. The thermal transfer receiving sheet according to claim 9 wherein the integral (PY value) of the power spectrum at wavelengths of 1-12.5 mm of said support surface is 150 mV or less.

13. The thermal transfer receiving sheet according to claim 1 wherein the mean particle size of the above hollow particles is 0.1 mm or greater and 20 mm or smaller.

14. The thermal transfer receiving sheet according to claim 1 wherein said support has an adhesive layer on the other side of the image receiving layer and wherein said adhesive layer side and the release layer side of the release sheet having a release layer containing a release agent have been laminated to face each other.

15. A thermal transfer receiving sheet having laminated, on one side of its support, an intermediate layer, a barrier layer and an image receiving layer in this order, wherein said intermediate layer comprises hollow particles, and said barrier layer comprises, as main components, an ethylene vinyl alcohol copolymer and polyurethane.

16. The thermal transfer receiving sheet according to claim 15 wherein the mean particle size of the above hollow particles is 0.1 mm or greater and 20 mm or smaller.

17. The thermal transfer receiving sheet according to claim 16 wherein said support has an adhesive layer on the other side of the image receiving layer and wherein said adhesive layer side and the release layer side of the release sheet having a release layer containing a release agent have been laminated to face each other.

18. The thermal transfer receiving sheet according to claim 17 wherein the integral (PY value) of the power spectrum at wavelengths of 1-12.5 mm of said support surface is 150 mV or less.

19. The thermal transfer receiving sheet according to claim 17 wherein said support has an adhesive layer on the other side of the image receiving layer and wherein said adhesive layer side and the release layer side of the release sheet having a release layer containing a release agent have been laminated to face each other.

20. The thermal transfer receiving sheet according to claim 19 wherein the integral (PY value) of the power spectrum at wavelengths of 1-12.5 mm of said support surface is 150 mV or less.

* * * * *